US006196175B1

(12) United States Patent
Church

(10) Patent No.: US 6,196,175 B1
(45) Date of Patent: Mar. 6, 2001

(54) HYDRAULICALLY ACTUATED VALVE DEACTIVATING ROLLER FOLLOWER

(75) Inventor: Kynan L. Church, Ceresco, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/255,366

(22) Filed: Feb. 23, 1999

(51) Int. Cl.[7] ..... F01L 1/14; F01L 13/00; F02D 13/02

(52) U.S. Cl. ..... 123/90.16; 123/90.5; 123/90.55; 123/198 F

(58) Field of Search ..... 123/90.15, 90.16, 123/90.17, 90.39, 90.48, 90.49, 90.5, 90.55, 198 F

(56) References Cited

U.S. PATENT DOCUMENTS

| | | | | |
|---|---|---|---|---|
| 4,770,137 | | 9/1988 | Okabe et al. | 123/198 F |
| 5,351,662 | | 10/1994 | Dopson et al. | 123/90.16 |
| 5,398,648 | * | 3/1995 | Spath et al. | 123/90.16 |
| 5,402,756 | * | 4/1995 | Bohme et al. | 123/90.16 |
| 5,555,861 | * | 9/1996 | Mayr et al. | 123/90.16 |
| 5,655,490 | | 8/1997 | Maas et al. | 123/90.16 |
| 5,669,342 | * | 9/1997 | Speil | 123/90.16 |
| 5,782,216 | * | 7/1998 | Haas et al. | 123/90.16 |
| 5,832,884 | * | 11/1998 | Haas et al. | 123/90.16 |
| 5,934,232 | * | 8/1999 | Greene et al. | 123/90.16 |
| 6,053,133 | * | 4/2000 | Faria et al. | 123/90.16 |

* cited by examiner

*Primary Examiner*—Weilun Lo
(74) *Attorney, Agent, or Firm*—L. J. Kasper

(57) ABSTRACT

A valve deactivator assembly (47) especially for use with a push rod (23) type of valve gear train, the deactivator assembly (47) preferably comprising a roller follower, engaging the engine cam (19). The deactivator includes an outer body (53), driven by the cam (19), and an inner body (61) which transmits cyclical motion to the push rod (23), when the body members are latched (FIG. 2). The inner body member (61) defines a latch chamber (93), oriented radially, and aligned therewith is a circular opening (97) defined by the outer body member (53). A compression spring (107) biases a latch member (99) toward the latched condition (FIG. 2). An end surface (111) of the latch member (99) is in communication with an engine oil passage (P), and a relatively higher pressure in the passage biases the latch member (99) toward an unlatched condition (FIG. 3), in opposition to the compression spring (107). As a result of the invention, valve deactivation may be provided in a roller follower without substantial engine redesign or substantial increase in the overall size of the roller follower.

14 Claims, 3 Drawing Sheets

HYDRAULICALLY ACTUATED VALVE DEACTIVATING ROLLER FOLLOWER

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to an improved valve train for an internal combustion engine, and more particularly, to a valve deactivator assembly for use therein.

Although the valve deactivator assembly of the present invention may be utilized to introduce some additional lash into the valve train, such that the valves open and close by an amount less than the normal opening and closing, the invention is especially suited for introducing into the valve train sufficient lash (also referred hereinafter as "lost motion"), such that the valves no longer open and close at all, and the invention will be described in connection therewith.

Valve deactivators of the general type to which the invention relates are known, especially in connection with internal combustion engines having push rod type valve gear train in which there is a rocker arm, with one end of the rocker arm engaging a push rod, and the other end engaging the engine poppet valve. Typically, a central portion of the rocker arm is fixed relative to the cylinder head (or other suitable structure) by a fulcrum arrangement as is well known to those skilled in the art, in which the fulcrum normally prevents movement of the central portion of the rocker arm in an "up and down" direction. At the same time, the fulcrum permits the rocker arm to engage in cyclical, pivotal movement, in response to the cyclical motion of the push rod, which results from the engagement of the push rod with the lobes of the rotating camshaft.

There are a number of known valve deactivator assemblies which are operably associated with the fulcrum portion of the rocker arm and which, in the latched condition, restrain the fulcrum portion of the rocker arm to move in its normal cyclical, pivotal movement. However, in an unlatched condition, the valve deactivator assembly permits the fulcrum portion of the rocker arm to engage in "lost motion" such that the cyclical, pivotal movement of the push rods causes the rocker arm to undergo cyclical, pivotal movement about the end which is in engagement with the engine poppet valve. In other words, the rocker arm merely pivots, but the engine poppet valve does not move and hence, is in its deactivated condition.

Although the known valve deactivator assemblies of the type referred to above have performed in a generally satisfactory manner, such assemblies do add substantially to the overall cost of the valve gear train, and in many cases, also add undesirably to the space taken up by the overall rocker arm installation. In some engine designs, there is simply no room to add a valve deactivator assembly to the rocker arm.

Typically, in a push rod type of valve gear train, there is some sort of cam follower device having one portion thereof in engagement with the cam lobe on the engine cam shaft, and another portion thereof in engagement with the lower end of the push rod. It is also known for such a cam follower mechanism to include a hydraulic lash compensation element.

It has been recognized by those skilled in the art as being desirable to incorporate the valve deactivator assembly into the cam follower, thus eliminating the need for adding a substantial, expensive, space consuming structure to the rocker arm assembly. However, in many engines, it would not be acceptable to increase substantially the size of the cam follower, in order to incorporate therein a valve deactivator assembly.

BRIEF SUMMARY OF THE INVENTION

Accordingly, it is an object of the present invention to provide an improved valve deactivator assembly which overcomes the above-described disadvantages of the prior art.

It is a more specific object of the present invention to provide an improved valve deactivator assembly, especially suited for push rod type valve gear, wherein the valve deactivator does not comprise part of the rocker arm assembly, but instead, comprises part of the cam follower assembly.

It is a related object of the present invention to provide an improved valve deactivator assembly, which accomplishes the above-stated objects, without substantially increasing the overall size of the cam follower mechanism.

The above and other objects of the invention are accomplished by the provision of a valve deactivator assembly for an internal combustion engine of the type having valve means for controlling the flow to and from a combustion chamber, and drive means for providing cyclical motion for opening and closing the valve means in timed relationship to the events in the combustion chamber. A valve gear means is operative in response to the cyclical motion to effect cyclical opening and closing of the valve means. The valve deactivator assembly comprises part of said valve gear means, and is disposed in series relationship between the drive means and the valve means.

The improved valve deactivator assembly is characterized by an outer body member disposed for engagement with the drive means and for the cyclical motion therewith. An inner body member is disposed within the outer body member and is reciprocable relative thereto, the inner body member including means operable to transmit the cyclical motion to the remainder of the valve gear means when the outer and inner body members are in a latched condition. A latch assembly is wholly disposed within the inner body member when the outer and inner body members are in an unlatched condition. The latch assembly includes a radially moveable latch member, and means biasing the latch member toward the latched condition. A source of pressurized fluid is operably associated with the latch assembly, and is operable to bias the latch member toward the unlatched condition.

DETAILED DESCRIPTION OF THE PREFERRED EMBODIMENT

Figure 1:
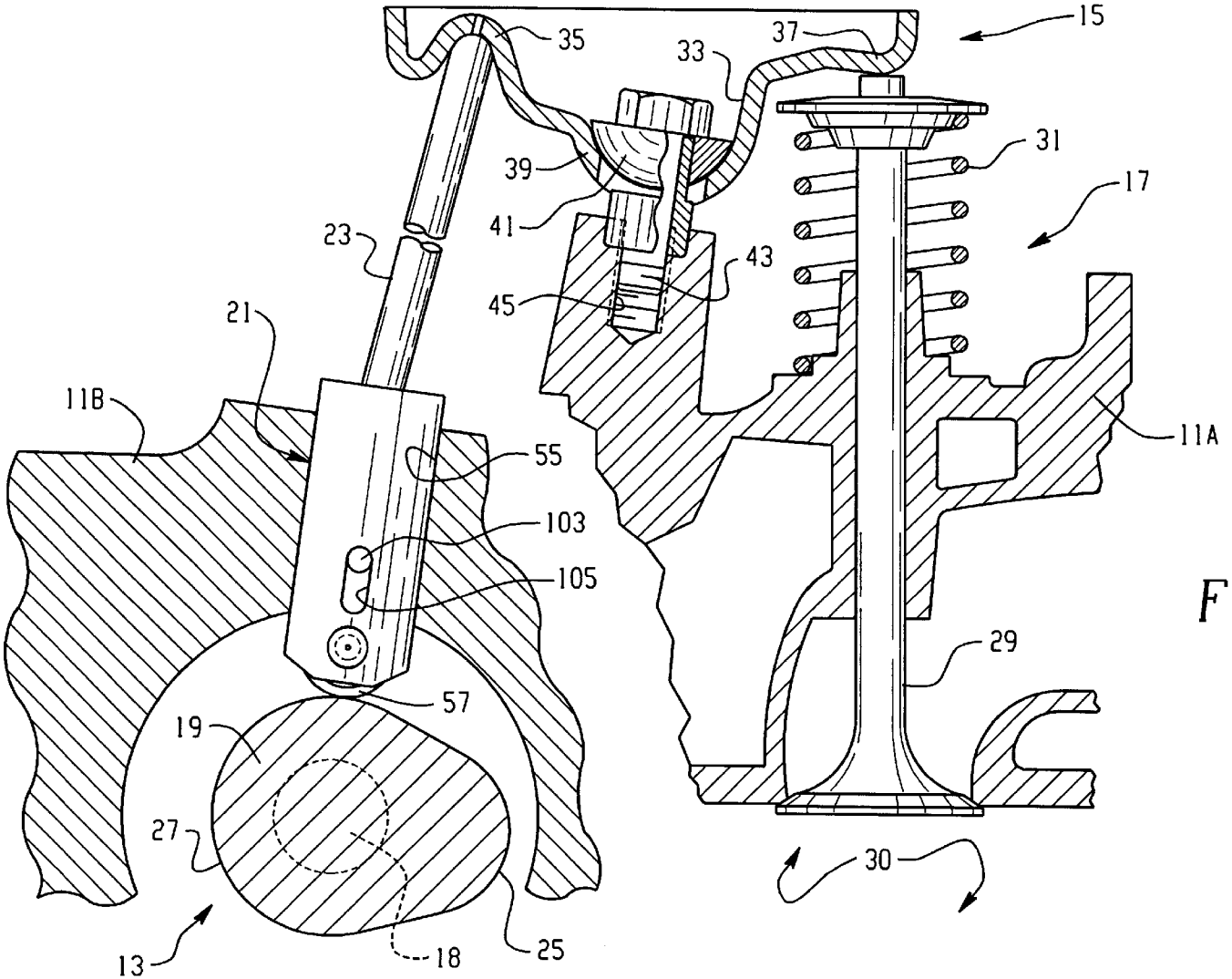
FIG. 1 is a fragmentary, axial cross-section taken through a vehicle internal combustion engine, illustrating a typical valve gear train of the type with which the present invention may be utilized.

Referring now to the drawings, which are not intended to limit the invention, FIG. 1 illustrates a valve actuating drive train of the push rod type, although it should be understood that the use of the present invention is not so limited. FIG. 1 illustrates a cylinder head 11A and an engine block 11B, on which are mounted a drive assembly 13 (on the engine block 11B), and a rocker arm assembly 15, and an engine poppet valve assembly, generally designated 17 (on the cylinder head 11A). Those skilled in the engine art will understand that the spatial relationship of the cylinder head 11A and the engine block 11B, as shown in FIG. 1, is for ease of illustration only.

The drive assembly 13 includes a camshaft 18 having a cam 19, a hydraulic roller follower 21, and a push rod 23. The cam 19 includes a lift portion 25 and a dwell (base circle) portion 27. The poppet valve assembly 17 includes a poppet valve 29, operable to control flow to and from a combustion chamber 30, and a spring 31 which biases the poppet valve 29 toward the closed position shown in FIG. 1, as is well known to those skilled in the art.

The rocker arm assembly 15 includes a rocker arm 33 of the center-pivot type, the rocker arm 33 including one end 35 which is adapted to receive cyclical input motion from the push rod 23, and another end 37 which is adapted to transmit to the valve 29 the cyclical motion of the push rod 23. As a result, the engine poppet valve 29 has a cyclical opening and closing motion, corresponding to that of the push rod 23, all of which is well known to those skilled in the art. In the subject embodiment, the only motion of the rocker arm 33 is its pivotal movement, with the ends 35 and 37 engaging in alternating up and down movement.

The rocker arm 33 includes a pivot portion 39, disposed intermediate the ends 35 and 37, and a fulcrum 41 is disposed within the pivot portion 39 in a manner which permits the rocker arm 33 to pivot as described previously. The fulcrum 41 has a threaded mounting bolt 43 extending therethrough and being in threaded engagement with an internally threaded bore 45 defined by the cylinder head 11A. It should be understood that the present invention is not limited to any particular type or configuration of rocker arm or fulcrum arrangement.

Figure 2:
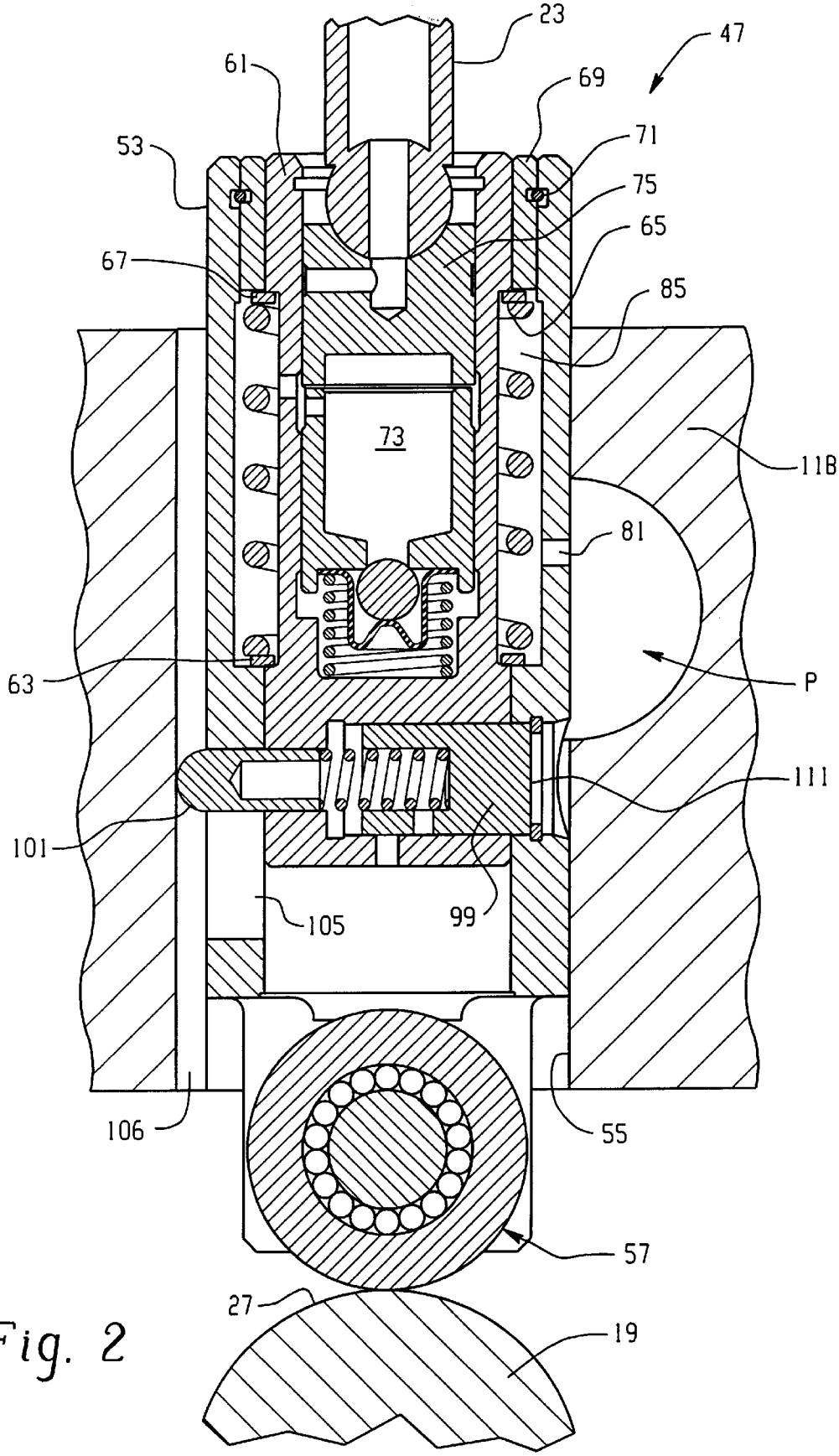
FIG. 2 is a somewhat enlarged, fragmentary, axial cross-section illustrating the valve deactivator assembly of the present invention in its latched condition, with the cam follower on the base circle.
Figure 3:
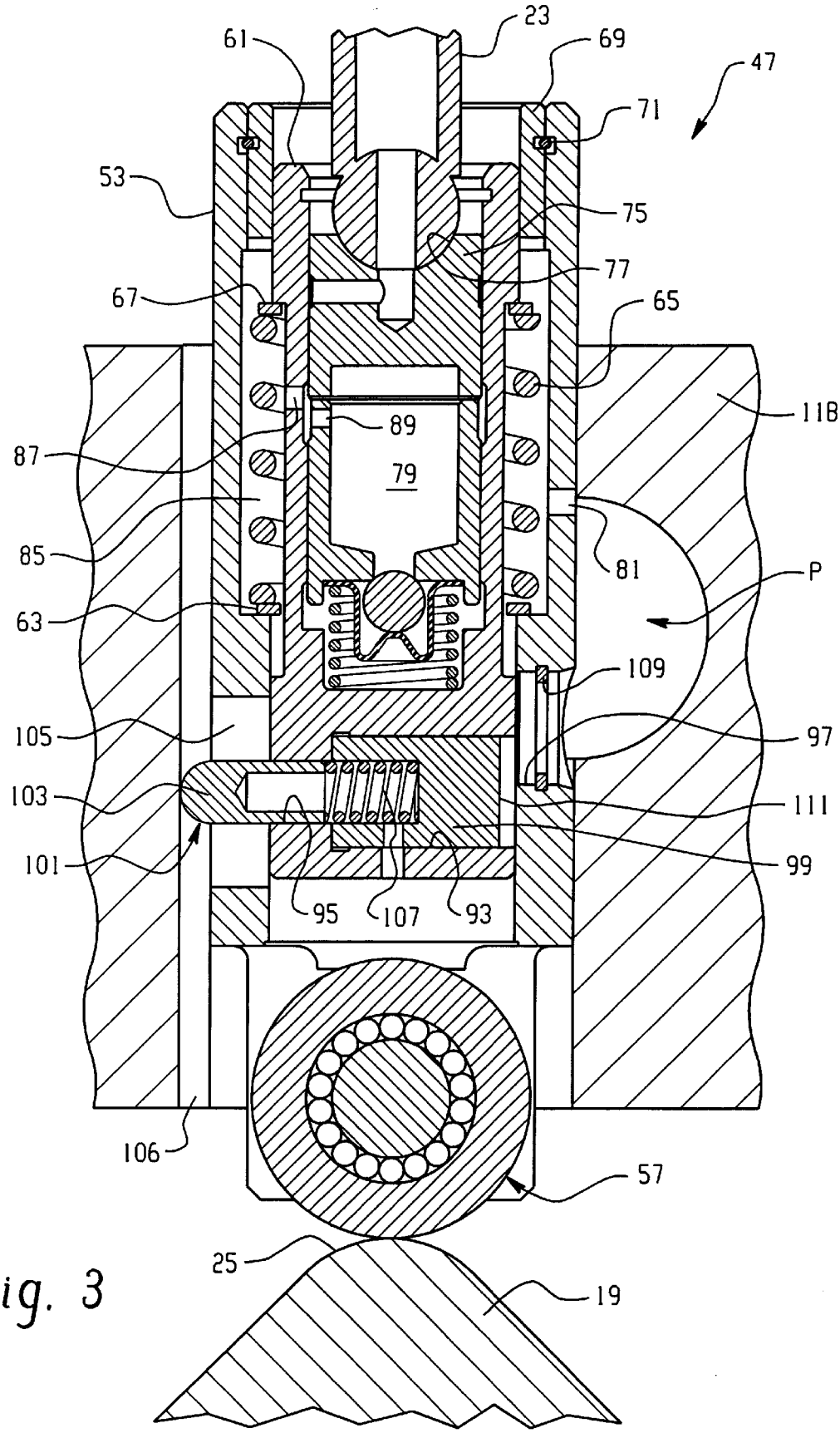
FIG. 3 is a further enlarged, fragmentary, axial cross-section of the valve deactivator assembly of the present invention in its unlatched condition, with the cam follower engaging the lift portion of the cam.

Typically, the present invention would be utilized with an eight cylinder engine, for which the valve drive train would include eight pairs of intake and exhaust valve rocker arms, four of the eight being equipped with a valve deactivator assembly, generally designated 47 (see FIGS. 2 and 3). In other words, four of the eight cylinders can be selectively deactivated by introducing sufficient "lost motion" into the valve drive train for that particular valve, so that the cyclical motion of the push rod 23 does not result in any corresponding cyclical opening and closing movement of the poppet valve 29 (i.e., of either the intake valve or the exhaust valve for that particular cylinder). More specifically, the lost motion is introduced into the drive train at the hydraulic roller follower 21, which, in the subject embodiment, actually comprises part of the valve deactivator assembly 47, as will be described further subsequently. Although not an essential feature of the invention, it is preferred that the valve deactivator assembly 47 operate by permitting lost motion between the cam 19 and the push rod 23, such that rotation of the cam 19 does not result in any pivotal movement of the rocker arm about its pivot portion 39.

In connection with the further description of the present invention, those skilled in the art will understand that where spatial terms such as "above" and "below", and terms of similar import, are used to specify general relationships between parts, they are not necessarily intended to indicate orientation of the parts within a vehicle engine, but are intended to show merely the relationship of the parts to each other within the drawings.

Referring now primarily to FIG. 2, the valve deactivator assembly 47 will be described in some detail, it being noted that it is also identified in FIG. 1 as being part of the hydraulic roller follower 21. An example of a conventional hydraulic roller follower, not having valve deactivation capability, is illustrated and described in U.S. Pat. No. 4,607,599, assigned to the assignee of the present invention and incorporated herein by reference.

The valve deactivator assembly 47 includes an outer body member 53 which is disposed to reciprocate within a bore 55 in the engine block 11B. The outer body member 53 is in contact with, and follows the cam 19 through a conventional roller follower 57, shown herein as being of the needle roller bearing type. Those skilled in the art will understand that the invention is not limited to any particular roller follower design, or for example, whether the axle of the roller is provided with needle bearings or merely a bushing, etc.

Disposed within the outer body member 53 is an inner body member 61. Toward the lower end, the inner body member 61 is surrounded by a stop clip 63 which serves as the lower spring seat for a lost motion compression spring 65. At its upper end, the spring 65 is seated against another stop clip 67, which engages a shoulder on the outer periphery of the inner body member 61. Above the stop clip 67 and disposed radially between the inner surface of the outer body member 53 and the outer surface of the inner body member 61, is a pilot ring 69 having its upper end fixed relative to the outer body member 53, by any suitable means, such as a wire snap ring 71.

Referring now primarily to FIG. 3, disposed within the inner body member 61 is a hydraulic lash compensation element, generally designated 73, of a general type which is now well known to those skilled in the art, and which will not be described in great detail herein. The lash compensation element 73 includes a plunger member 75 defining a socket surface 77, adapted for engagement with the push rod 23, in a manner also well known to those skilled in the art. The lash compensation element 73 defines a fluid reservoir 79 which receives pressurized engine oil by means of a fluid port 81, defined by the outer body member 53, and being in fluid communication with an engine oil passage P formed in the engine block 11B. Such pressurized fluid fills a chamber 85 formed between the outer body member 53 and the inner body member 61. From the chamber 85, fluid flows through a fluid port 87 formed in the cylindrical wall of the inner body member 61, then through a fluid port 89 formed in the lash compensation element 73, then enters the fluid reservoir 79. Disposed between a lower portion of the inner body member 61 and the lash compensation element 73 is a high pressure chamber 91, the function of which is to contain fluid under substantial pressure during a valve event, thus providing some rigidity within the valve gear train, but also providing the capability of compensation for lash, as is well known to those skilled in the lash compensation art.

Referring still primarily to FIG. 3, the lower portion of inner body member 61 defines a pair of diametrically arranged bores including a relatively larger bore defining a latching chamber 93, and a relatively smaller bore 95, the function of which will be described subsequently. Preferably, the latching chamber 93 is cylindrical, and the cylindrical wall of the outer body member 53 defines a generally circular opening 97 which preferably has the same cross-sectional area and configuration as the latching chamber 93. It should be understood that within the scope of the present invention, the latching chamber 93 and the opening 97 could have cross-sectional configurations other than circular, but a circular configuration is generally preferred for reasons such as ease of manufacturing. However, all that is actually essential, is that the chamber 93 and opening 97 have a sufficiently similar size and configuration to facilitate the latched condition, as shown in FIG. 2 and as will be described subsequently.

Reciprocably disposed within the latching chamber 93 is a latch member 99, preferably having the same size and configuration as the chamber 93, providing for suitable clearances therebetween. Disposed within the relatively smaller bore 95 is an alignment member 101, including a radially outer portion 103 disposed within an elongated opening 105 defined in the side wall of the outer body member 53. It should be noted that the outer portion 103 and the elongated opening 105 are shown in FIG. 1, but are disposed 90 degrees offset from the position of FIGS. 2 and 3. As may best be seen in FIG. 3, the portion 103 rides in a vertically, axially extending slot 106, thus preventing rotation of the deactivator 47 within the bore 55, and assuring that, as one example, the circular opening 97 will remain in communication with the engine oil passage P.

Preferably, there is a fairly close fit between the opening 105 and the portion 103 (see FIG. 1). As a result, the inner body member 61 is maintained in the desired circumferential alignment relative to the outer body member 53, i.e., the inner body member 61 is not permitted to rotate within the outer body member 53. This arrangement of the outer portion 103 within the opening 105 will assure that the latching chamber 93 and the opening 97 are always aligned, whether the deactivator assembly 47 is in the latched or the unlatched condition.

Disposed between the alignment member 101 and the latch member 99 is a compression spring 107, seated against the stationary alignment member 101, and biasing the moveable latch member 99 to the right in FIGS. 2 and 3, toward the latched condition shown in FIG. 2. Disposed within the circular opening 97 is a snap ring 109, or other suitable travel limiting means, effective to limit the rightward movement of the latch member 99 when the valve deactivator assembly 47 is in the latched condition of FIG. 2.

As will be explained in greater detail subsequently, when it is desired to deactivate the engine valve 29, an appropriate signal is transmitted to the engine oil pressure system, increasing the oil pressure in the engine oil passage P. The increased oil pressure is communicated through the opening 97 and contacts an end surface 111 of the latch member 99, biasing the latch member out of the latched condition shown in FIG. 2 toward an unlatched condition as shown in FIG. 3. In the subject embodiment, there is shown only a single engine oil passage P communicating with both the fluid port 81, to provide oil to the lash compensation element 73, and the opening 97, to unlatch the latch member 99 as described above. However, within the scope of the invention, there could be separate oil passages, one feeding the fluid port 81, and therefore, able to remain at a relatively constant, low pressure, and another passage communicating with the opening 97, with the pressure in that passage being controlled to accomplish the latching and unlatching.

As is typical in the valve deactivator art, mode transitions, either from the latched condition to the unlatched condition, or vice versa, occur only when the cam 19 is on the base circle portion 27, i.e., when the roller follower 57 is engaging the base circle portion 27. As is well known to those skilled in the art, this is done in order that the mode change is occurring while the valve deactivator assembly 47, and more specifically, the latching mechanism, is not under load. For example, in FIG. 2, even though the deactivator assembly 47 is in the latched condition, it is unloaded, i.e., the latch member 99 could easily be slid from the latched condition shown to the unlatched condition of FIG. 3. However, after the cam 19 would rotate about a quarter of a turn, and the follower would begin to engage the lift portion 25, there would be an upward force exerted on the outer body member 53, which would then be transmitted through the latch member 99 to the inner body member, the condition referred to as the deactivator assembly 47 being "loaded". As should be apparent, with the deactivator 47 loaded, the latch member 99 could not be moved between the latched and the unlatched conditions, except perhaps with the exertion of great force.

During operation, with the deactivator assembly 47 in the latched condition shown in FIG. 2, as the cam 19 rotates, the lift portion 25 begins to engage the roller follower 57. Thus, the force needed to open the engine valve 29 is transmitted to the follower 57, then to the outer body member 53, then through the latch member 99 to the inner body member 61, as explained above, then through the lash compensation element 73 to the push rod 23. Therefore, in the latched condition, the cyclical motion of the cam 19 is transmitted to the push rod 23 and then to the engine valve 29 in the same manner as if there were only the conventional, rigid roller follower 21 present.

When it is desired to deactivate the poppet valve 29, the pressure is increased in the engine oil passage P to a level sufficient to bias the latch member 99 to the left in FIGS. 2 and 3, in opposition to the biasing force of the spring 107, moving the latch member 99 to the fully retracted, unlatched condition shown in FIG. 3. In the unlatched condition, as the cam 19 rotates, and the lift portion 25 engages the roller follower 57, the cyclical motion is transmitted to the follower 57 and to the outer body member 53. However, in the unlatched condition, the cyclical motion of the outer body member 53 simply compresses the spring 65, but does not move the inner body member 61, because the biasing force of the spring 31 is substantially greater than that of the spring 65.

Referring still to FIG. 3, when the deactivator assembly 47 is operating in the unlatched condition, after the cam 19 rotates past the peak lift position shown, and the roller follower 57 moves toward the base circle portion, it is important for the compression spring 65 to exert sufficient force to maintain the follower 57 in engagement with the surface of the cam 19. As the outer body member 53 moves upward relative to the inner body member 61, as the follower 57 moves toward the peak lift position, the spring 65 is compressed until it reaches the condition shown in FIG. 3. It should be noted that during such relative movement of the outer and inner body members 53 and 61, the volume of the chamber 85 does not change substantially. If the chamber 85 did vary in volume, such variation would create pressure pulses within the engine oil system, which could interfere with the operation of other components of the system.

As may best be seen in FIG. 3, the moveable part of the latch assembly, i.e., the latch member 99, is totally disposed within the inner body member 61, when the assembly 47 operates in the unlatched condition, with the latch member 99 moving radially outward to engage the outer body member 53, in the latched condition. Therefore, references hereinafter to the latch assembly being wholly disposed within the inner body member 61 will be understood to refer only to the latch member 99 and the compression spring 107, and not to the alignment member 101. The above-described arrangement makes it possible to achieve one of the objects of the invention, i.e., not to substantially increase the overall size of the roller follower. Thus, in terms of packaging size, the present invention makes the deactivator assembly 47 basically "free", i.e., the deactivation capability is added to the valve gear train without any substantial change of the overall size, shape or configuration of the valve gear train. However, those skilled in the engine art will understand the need to add oil pressure controls, and possibly also add some additional drilled oil passages.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve deactivator assembly for an internal combustion engine of the type having valve means for controlling the flow to and from a combustion chamber, drive means for providing cyclical motion for opening and closing said valve means in timed relationship to the events in said combustion chamber and valve gear means operative in response to said cyclical motion to effect cyclical opening and closing of said valve means; said valve deactivator assembly comprising part of said valve gear means, and being disposed in series relationship between said drive means and said valve means; said valve deactivator assembly being characterized by:

(a) an outer body member defining a longitudinal axis, and disposed for engagement with said drive means and for said cyclical motion therewith;

(b) an inner body member disposed within said outer body member and reciprocable relative thereto, said inner body member including means operable to transmit said cyclical motion to the remainder of said valve gear means when said outer and inner body members are in a latched condition, said outer body member being generally cylindrical and hollow, and said inner body member being generally cylindrical and hollow, said outer and said inner body members defining therebetween a generally annular chamber;

(c) a latch assembly wholly disposed within said inner body member when said outer and inner body members are in an unlatched condition, said latch assembly including a radially moveable latch member and means biasing said latch member toward said latched condition; and (d) a source of pressurized fluid operably associated with said latch assembly and operable to bias said latch member toward said unlatched condition said outer body member defining a first fluid port adapted for communication with said source of pressurized fluid, said first fluid port being in relatively unrestricted fluid communication with said generally annular chamber.

2. A valve deactivator assembly as claimed in claim 1, characterized by said drive means comprises a cam shaft having a cam defining a base circle portion and a lift portion.

3. A valve deactivator assembly as claimed in claim 2, characterized by said valve gear means comprises a rocker arm in operable engagement with said valve means, and a push rod in operable engagement with said rocker arm.

4. A valve deactivator assembly as claimed in claim 3, characterized by said inner body member including means defining a socket surface adapted for engagement with said push rod, said means operable to transmit said cyclical motion to the remainder of said valve gear means comprising said means defining said socket surface.

5. A valve deactivator assembly as claimed in claim 4, characterized by said means defining said socket surface comprises a hydraulic lash compensation assembly reciprocably disposed within said inner body member.

6. A valve deactivator assembly as claimed in claim 2, characterized by said outer body member including a roller-type cam follower adapted for engagement with said base circle portion and said lift portion of said cam as said cam shaft rotates.

7. A valve deactivator assembly as claimed in claim 1, characterized by said engine including an engine block defining a bore disposed adjacent said drive means, said outer body member of said valve deactivator assembly being generally cylindrical and adapted for reciprocation within said bore.

8. A valve deactivator assembly as claimed in claim 1, characterized by a coil spring being disposed within said annular chamber, said spring having an upper end seated relative to said inner body member, and a lower end seated relative to said outer body member, whereby said spring biases said members, toward a retracted position relative to each other.

9. A valve deactivator assembly as claimed in claim 1, characterized by said inner body member defining a second fluid port, in relatively unrestricted fluid communication with said generally annular chamber, said second fluid port communicating pressurized fluid to a hydraulic lash compensation assembly reciprocably disposed within said inner body member, said hydraulic lash compensation assembly comprising said means operable to transmit said cyclical motion to the remainder of said valve gear means.

10. A valve deactivator assembly as claimed in claim 9, characterized by an annular pilot member disposed radially between an inner surface of said outer body member and an outer surface of said inner body member, said inner and outer body members and said pilot member cooperating to define said generally annular chamber, said inner surface and said outer surface being configured such that reciprocation between said inner and outer body members results in no substantial change in the fluid volume of said annular chamber.

11. A valve deactivator assembly as claimed in claim 1, characterized by said moveable latch member being generally cylindrical, and said inner body member defining a generally cylindrical latch chamber configured to receive said moveable latch member reciprocably disposed therein.

12. A valve deactivator assembly as claimed in claim 11, characterized by said outer body member defining a generally circular opening in the cylindrical wall of said outer body member, said cylindrical latch chamber and said circular opening being in alignment, and permitting said moveable latch member to be in engagement with both said cylindrical latch chamber and said circular opening when said outer and inner body members are in said latched condition.

13. A valve deactivator assembly as claimed in claim 12, characterized by said outer body member defining an elongated opening disposed approximately diametrically opposite said circular opening, and said inner body member including an alignment member having a radially outer portion thereof disposed within said elongated opening, whereby said cylindrical latch chamber and said circular opening are maintained in circumferential alignment.

14. A valve deactivator assembly as claimed in claim 12, characterized by said source of pressurized fluid being in open fluid communication with said circular opening defined by said outer body member whereby said moveable latch member has a radially outer end surface in fluid communication with said source of pressurized fluid, a relatively higher fluid pressure at said source being operable to bias said latch member toward said unlatched condition.

* * * * *